US009528754B2

(12) United States Patent
Kerner

(10) Patent No.: US 9,528,754 B2
(45) Date of Patent: Dec. 27, 2016

(54) CONFIGURABLE POWER SUPPLY CIRCUIT FOR LIGHTED SHELVES IN A REFRIGERATOR

(71) Applicant: Whirlpool Corporation, Benton Harbor, MI (US)

(72) Inventor: James Kerner, Indianapolis, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 708 days.

(21) Appl. No.: 13/761,820

(22) Filed: Feb. 7, 2013

(65) Prior Publication Data

US 2014/0217879 A1 Aug. 7, 2014

(51) Int. Cl.

| | |
|---|---|
| ***F25D 27/00*** | (2006.01) |
| ***F25D 23/00*** | (2006.01) |
| ***F25D 25/02*** | (2006.01) |
| ***H05B 33/08*** | (2006.01) |

(52) U.S. Cl.

CPC ..... *F25D 27/005* (2013.01); *F25D 25/02* (2013.01); *H05B 33/0806* (2013.01)

(58) Field of Classification Search

CPC ..... F05D 25/02; F05D 25/024; F05D 27/00; F05D 27/005

USPC .. 62/264; 312/223.5, 280, 281, 408; 108/23; 362/127; 211/90.01, 90.02, 90.04

See application file for complete search history.

(56) References Cited

U.S. PATENT DOCUMENTS

| | | | | |
|---|---|---|---|---|
| 3,506,325 | A | 4/1970 | Horvay | |
| 4,689,726 | A | 8/1987 | Kretzschmar | |
| 5,034,861 | A | 7/1991 | Sklenak et al. | |
| 5,287,252 | A | 2/1994 | Caruso | |
| 5,600,310 | A | 2/1997 | Whipple, III et al. | |
| 6,786,562 | B2 | 9/2004 | Obrock et al. | |
| 6,813,896 | B1 * | 11/2004 | Janke | F25D 25/02 62/126 |
| 7,107,779 | B2 | 9/2006 | Avenwedde et al. | |
| 7,163,305 | B2 | 1/2007 | Bienick | |
| 7,178,941 | B2 | 2/2007 | Roberge et al. | |
| 7,338,180 | B2 | 3/2008 | Wing | |
| 7,434,951 | B2 | 10/2008 | Bienick | |

(Continued)

FOREIGN PATENT DOCUMENTS

| | | |
|---|---|---|
| DE | 20 2012 00835 | 10/2012 |
| KR | 2008/0022440 | 3/2008 |
| WO | 2010/133478 | 11/2010 |

OTHER PUBLICATIONS

Machine Translation Kim KR-20080022440.*

*Primary Examiner* — Ryan J Walters
*Assistant Examiner* — Antonio R Febles

(57) ABSTRACT

A refrigerator appliance includes a cabinet having a temperature-controlled compartment defined therein and a plurality of electrical connectors disposed at a plurality of shelf mounting positions within the temperature-controlled compartment. The refrigerator appliance also includes a plurality of adjustable shelves each carrying at least one light emitting diode (LED), where each of the plurality of adjustable shelves is removably mounted in one of the plurality of shelf mounting positions such that the at least one LED is electrically coupled to one of the plurality of electrical connectors. The refrigerator appliance further includes a power supply circuit that is electrically coupled to the plurality of electrical connectors and that is configured to selectively supply power to only a subset of the plurality of electrical connectors.

18 Claims, 6 Drawing Sheets

(56) References Cited

U.S. PATENT DOCUMENTS

| | | | | |
|---|---|---|---|---|
| 7,744,252 | B2 | 6/2010 | Maxik | |
| 7,748,806 | B2 | 7/2010 | Egan | |
| 7,824,055 | B2 * | 11/2010 | Sherman | 362/125 |
| 7,840,286 | B2 * | 11/2010 | Caldwell | A47B 57/00 700/17 |
| 8,044,415 | B2 | 10/2011 | Messere et al. | |
| 8,742,686 | B2 * | 6/2014 | Zampini et al. | 315/297 |
| 2004/0257760 | A1 * | 12/2004 | Record et al. | 361/685 |
| 2007/0145915 | A1 | 6/2007 | Roberge | |
| 2008/0043456 | A1 | 2/2008 | Bernardini | |
| 2009/0021927 | A1 | 1/2009 | Hall | |
| 2011/0121654 | A1 | 5/2011 | Recker | |
| 2011/0133655 | A1 | 6/2011 | Recker | |
| 2011/0164399 | A1 | 7/2011 | Driver | |
| 2011/0273867 | A1 | 11/2011 | Horst et al. | |
| 2012/0320627 | A1 | 12/2012 | Araki et al. | |

* cited by examiner

CONFIGURABLE POWER SUPPLY CIRCUIT FOR LIGHTED SHELVES IN A REFRIGERATOR

TECHNICAL FIELD

The present disclosure relates, generally, to refrigerator appliances and, more particularly, to systems and methods for powering lighted shelves in refrigerator appliances.

BACKGROUND

A refrigerator is an appliance used to store food items at preset temperatures. A refrigerator appliance typically includes one or more temperature-controlled compartments into which food items may be placed to preserve the food items for later consumption. A refrigerator appliance also typically includes a plurality of shelves on which the food items may be arranged within the one or more temperature-controlled compartments. In some refrigerator appliances, the plurality of shelves may be adjustable (i.e., the shelves may each be removably mounted in a plurality of shelf mounting positions). Some or all of the plurality of shelves may also carry one or more lighting devices for illuminating food items placed in the one or more temperature-controlled compartments.

SUMMARY

According to one aspect, a refrigerator appliance may comprise a cabinet having a temperature-controlled compartment defined therein. A shelf ladder disposed in the temperature-controlled compartment may provide a plurality of shelf mounting positions and may comprise a plurality of electrical connectors such that each of the plurality of shelf mounting positions has a corresponding electrical connector. The refrigerator appliance may also comprise a plurality of adjustable shelves each carrying at least one lighting device and each being removably mounted in one of the plurality of shelf mounting positions such that the at least one lighting device is electrically coupled to the corresponding electrical connector. The refrigerator appliance may further comprise a power supply circuit that is electrically coupled to the plurality of electrical connectors of the shelf ladder and that is configured to selectively supply power to only a subset of the plurality of electrical connectors.

In some embodiments, the plurality of adjustable shelves may be fewer in number than the plurality of shelf mounting positions provided by the shelf ladder. The plurality of electrical connectors may be part of an electrical bus that corresponds to two or more of the plurality of shelf mounting positions. The power supply circuit may comprise a jumper block including a plurality of electrical jumpers, where placement of the plurality of electrical jumpers within the jumper block selects the subset of the plurality of electrical connectors to which power is supplied.

In other embodiments, the at least one lighting device carried by each of the plurality of adjustable shelves may comprise at least one light emitting diode (LED). The power supply circuit may comprise an LED driver having a plurality of selectable power supply channels each being electrically coupled to one of the plurality of electrical connectors. The power supply circuit may further comprise an electronic controller communicatively coupled to the LED driver. The electronic controller may be configured to selectively activate the plurality of selectable power supply channels of the LED driver. The LED driver may be configured to determine an arrangement of the plurality of adjustable shelves by sensing whether each of the plurality of selectable power supply channels is electrically coupled to at least one lighting device. The electronic controller may be configured to selectively activate the plurality of selectable power supply channels of the LED driver in response to the arrangement of the plurality of adjustable shelves.

In still other embodiments, the power supply circuit may be further configured to selectively supply power to each of the plurality of electrical connectors from one or both of a first power source and a second power source. The first power source may be configured to supply power to the plurality of electrical connectors at a first current level and the second power source may be configured to supply power to the plurality of electrical connectors at a second current level, where the first current level is greater than the second current level.

According to another aspect, a refrigerator appliance may comprise a cabinet having a temperature-controlled compartment defined therein and a plurality of electrical connectors disposed at a plurality of shelf mounting positions within the temperature-controlled compartment. The refrigerator appliance may also comprise a plurality of adjustable shelves each carrying at least one light emitting diode (LED), where each of the plurality of adjustable shelves may be removably mounted in one of the plurality of shelf mounting positions such that the at least one LED is electrically coupled to one of the plurality of electrical connectors. The refrigerator appliance may further comprise a power supply circuit that is electrically coupled to the plurality of electrical connectors and that is configured to selectively supply power to only a subset of the plurality of electrical connectors.

In some embodiments, the power supply circuit may comprise a jumper block including a plurality of electrical jumpers, where placement of the plurality of electrical jumpers within the jumper block selects the subset of the plurality of electrical connectors to which power is supplied.

In other embodiments, the power supply circuit may comprise an LED driver having a plurality of selectable power supply channels each being electrically coupled to one of the plurality of electrical connectors. The power supply circuit may further comprise an electronic controller communicatively coupled to the LED driver. The electronic controller may be configured to selectively activate the plurality of selectable power supply channels of the LED driver. The LED driver may be configured to determine an arrangement of the plurality of adjustable shelves by sensing whether each of the plurality of selectable power supply channels is electrically coupled to at least one LED. The electronic controller may be configured to selectively activate the plurality of selectable power supply channels of the LED driver in response to the arrangement of the plurality of adjustable shelves.

In still other embodiments, the power supply circuit may be further configured to selectively supply power to each of the plurality of electrical connectors from one or both of a first power source and a second power source. The first power source may be configured to supply power to the plurality of electrical connectors at a greater current level than the second power source.

According to yet another aspect, a method may comprise determining an arrangement of a plurality of adjustable shelves in a refrigerator appliance, each of the plurality of adjustable shelves carrying at least one light emitting diode (LED) and being removably mounted within a temperature-controlled compartment of the refrigerator appliance. The method may also comprise selecting a subset of adjustable shelves from among the plurality of adjustable shelves in response to the determined arrangement of the plurality of adjustable shelves. The method may further comprise supplying power to the at least one LED carried by each of the selected subset of adjustable shelves.

In some embodiments, selecting the subset of adjustable shelves may comprise configuring a plurality of electrical jumpers within a jumper block. In other embodiments, supplying power to the at least one LED carried by each of the selected subset of adjustable shelves may comprise activating one or more selectable power supply channels of an LED driver, where the LED driver includes a selectable power supply channel electrically coupled to each location for removably mounting one of the plurality of adjustable shelves within the temperature-controlled compartment. In such embodiments, determining the arrangement of the plurality of adjustable shelves may comprise activating each selectable power supply channel of the LED driver and sensing an electrical response from each selectable power supply channel of the LED driver to determine whether one of the plurality of adjustable shelves is electrically coupled to the selectable power supply channel.

BRIEF DESCRIPTION OF THE DRAWINGS

The detailed description particularly refers to the following figures, in which.

Figure 1:
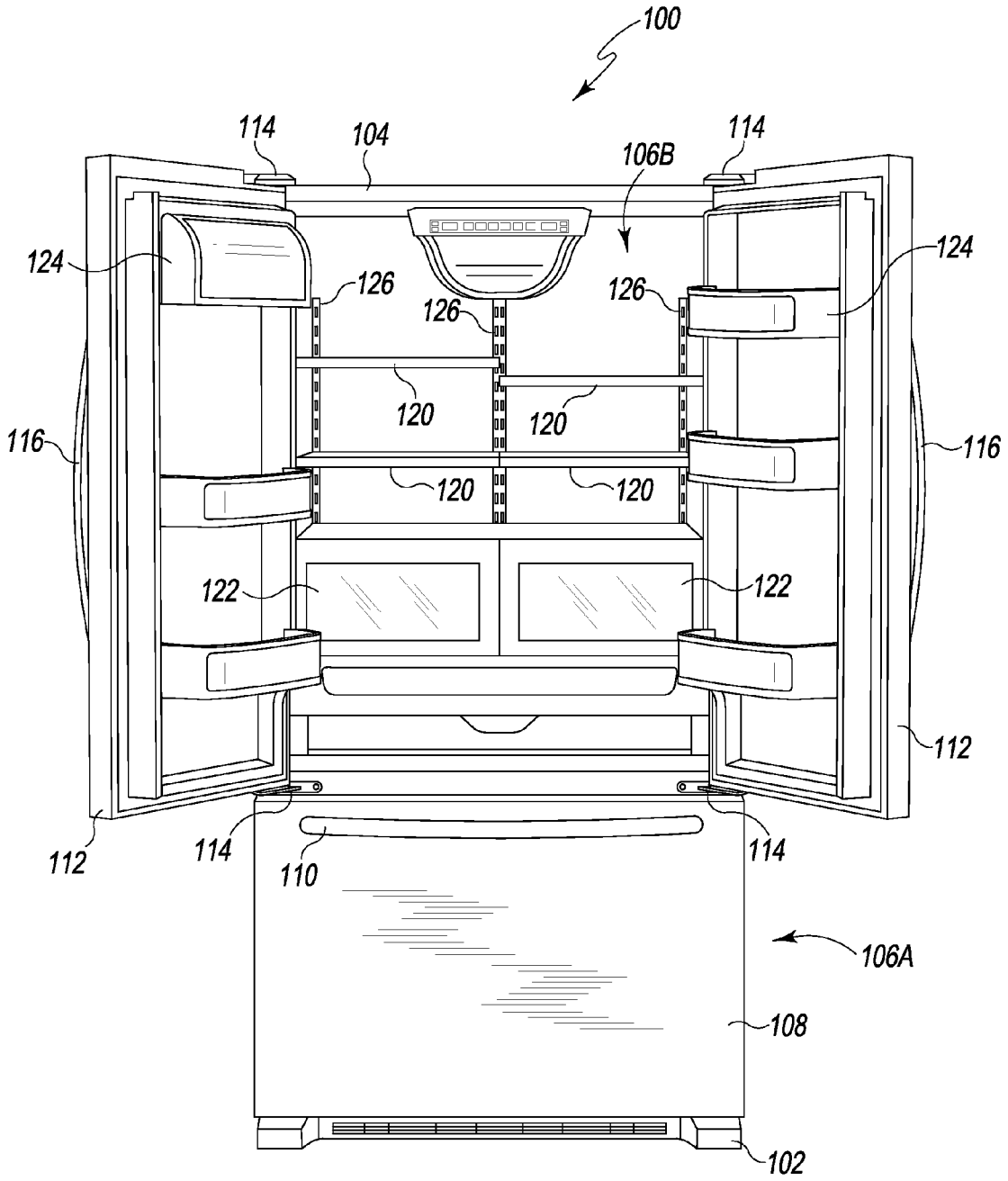
FIG. 1 is a front elevation view of a refrigerator appliance showing a plurality of adjustable shelves removably mounted in a plurality of shelf mounting positions within a temperature-controlled compartment of the refrigerator appliance.

Where considered appropriate, reference labels have been repeated among the figures to indicate corresponding or analogous elements.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a home appliance is shown as a refrigerator appliance 100 (hereinafter, the refrigerator 100). One illustrative example of the refrigerator 100 is the Whirlpool Latitude French Door Refrigerator, which is commercially available from Whirlpool Corporation of Benton Harbor, Mich. The refrigerator 100 includes a lower frame 102 and a cabinet 104 extending upwardly from the lower frame 102. The cabinet 104 of the refrigerator 100 includes a pair of temperature-controlled compartments 106 that are independently operable to maintain food items stored therein at one or more set temperatures.

The lower temperature-controlled compartment 106 is a freezer compartment 106A, and the refrigerator 100 includes a drawer 108 that is positioned in the freezer compartment 106A. The drawer 108 is moveable relative to the cabinet 104 such that food items may be placed in the drawer 108 for storage in the freezer compartment 106A and retrieved from the drawer 108 when ready for use. A handle 110 is located on the drawer 108 so that a user may open and close the drawer 108.

The upper temperature-controlled compartment 106 is a refrigerated compartment 106B into which a user may place and store food items such as milk, cheese, produce, etcetera. A pair of doors 112 are each hinged to the front of the cabinet 104 via a pair of hinge assemblies 114. The doors 112 permit user access to the refrigerated compartment 106B such that food items may be placed in and retrieved from the refrigerated compartment 106B. A handle 116 is located on each of the doors 112 so that a user may open and close the doors 112.

While the illustrative embodiment of the refrigerator 100 shown in FIG. 1 is a "french-door" model with a pair of doors 112 operable to permit access to the refrigerated compartment 106B, it should be appreciated that other configurations are contemplated, such as, for example, configurations having only one door 112 operable to permit access to the refrigerated compartment 106B. Additionally, it should also be appreciated that, in some embodiments, the freezer compartment 106A may be positioned above the refrigerated compartment 106B and, in other embodiments, either one of the temperature-controlled compartments 106 may be omitted. It should be further appreciated that, in some embodiments, the refrigerator 100 may include more than one freezer compartment 106A and/or more than one refrigerated compartment 106B. Configurations of the refrigerator 100 are also contemplated in which the freezer compartment 106A is located on one side of the cabinet 104 and the refrigerated compartment 106B is located on the opposite side of the cabinet 104.

As shown in FIG. 1, the refrigerator 100 also includes four adjustable shelves 120 removably mounted within the refrigerated compartment 106B, upon which a user of the refrigerator 100 may arrange food items. It is contemplated that the refrigerator 100 may include any number of adjustable shelves 120 within the temperature-controlled compartments 106. As the adjustable shelves 120 are removably mounted within the refrigerated compartment 106B, a user may remove any adjustable shelf 120 and relocate it to any available shelf mounting position within the refrigerated compartment 106B. It will be appreciated that the refrigerator 100 may additionally or alternatively include other devices for supporting or storing food within the temperature-controlled compartments 106, such as, for example, drawers 122 or door bins 124 (as shown in FIG. 1). As used in the present disclosure, the term "shelf" is to be considered in its broadest sense as any device that will hold a food item, including shelves, drawers, bins, panels, racks, and the like.

The adjustable shelves 120 may be removably mounted within the refrigerated compartment 106B using any suitable mechanism. In the illustrative embodiment of the refrigerator 100 shown in FIG. 1, three shelf ladders 126 are disposed within the refrigerated compartment 106B to provide a plurality of shelf mounting positions for the adjustable shelves 120. It is contemplated that any number of shelf ladders 126 may be used for removably mounting the adjustable shelves 120. In some embodiments, the shelf ladders 126 may be secured to one or more walls of the refrigerator compartment 106B using screws, bolts, rivets, adhesive, or other fixation mechanisms. In other embodiments, the shelf ladders 126 may be integrally formed into one or more walls of the refrigerator compartment 106B. It should also be appreciated that the adjustable shelves 120 may be removably mounted within the refrigerated compartment 106B using any number of mechanisms other than the shelf ladders 126. By way of example, the adjustable shelves 120 may be removably mounted within the refrigerated compartment 106B using ledges, tracks, slides, glides, rollers, and the like.

Figure 2A:
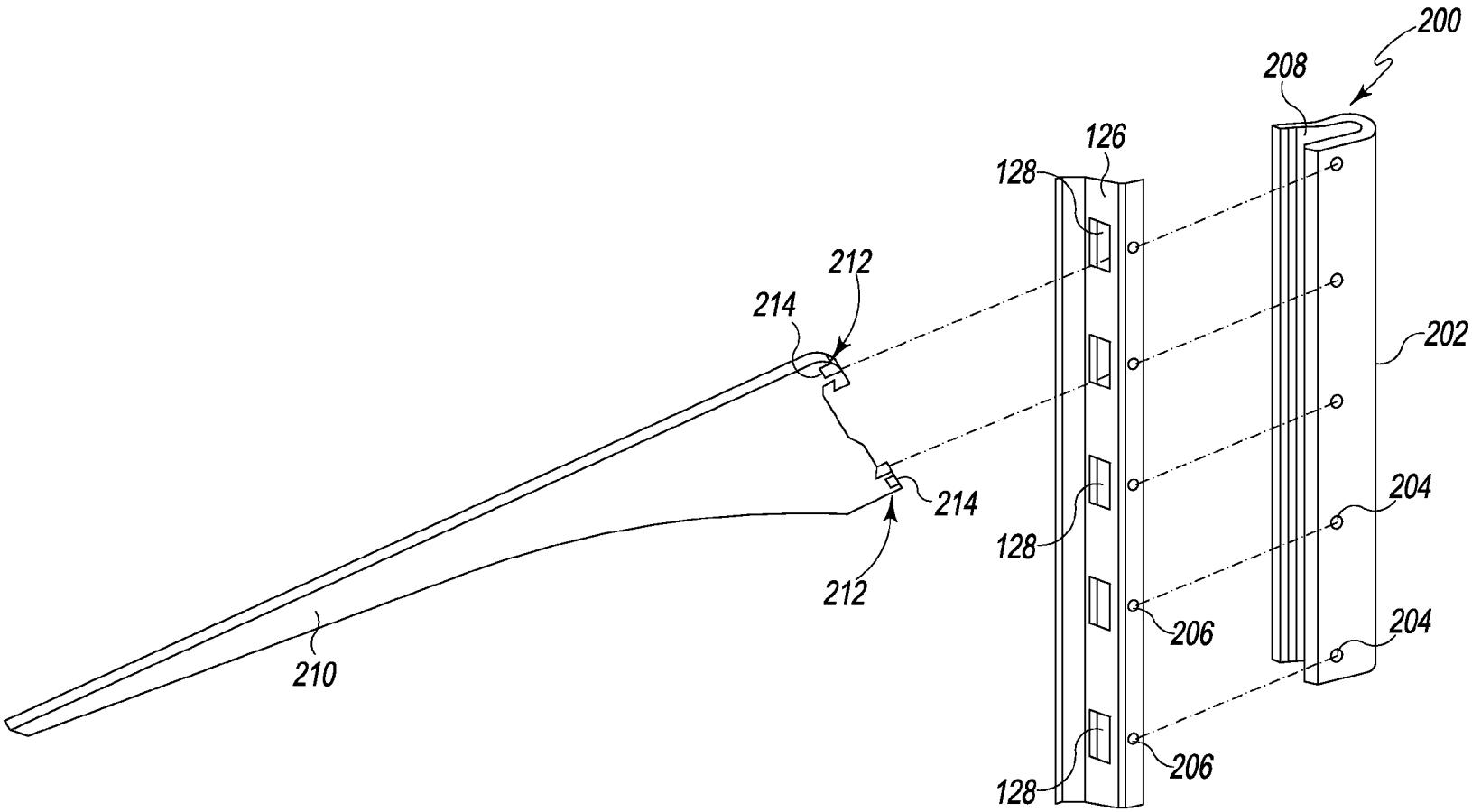
FIG. 2A is a partially exploded view of one embodiment of a shelf ladder, an electrical bus, and a shelf mounting bracket of the refrigerator appliance of FIG. 1.
Figure 2B:
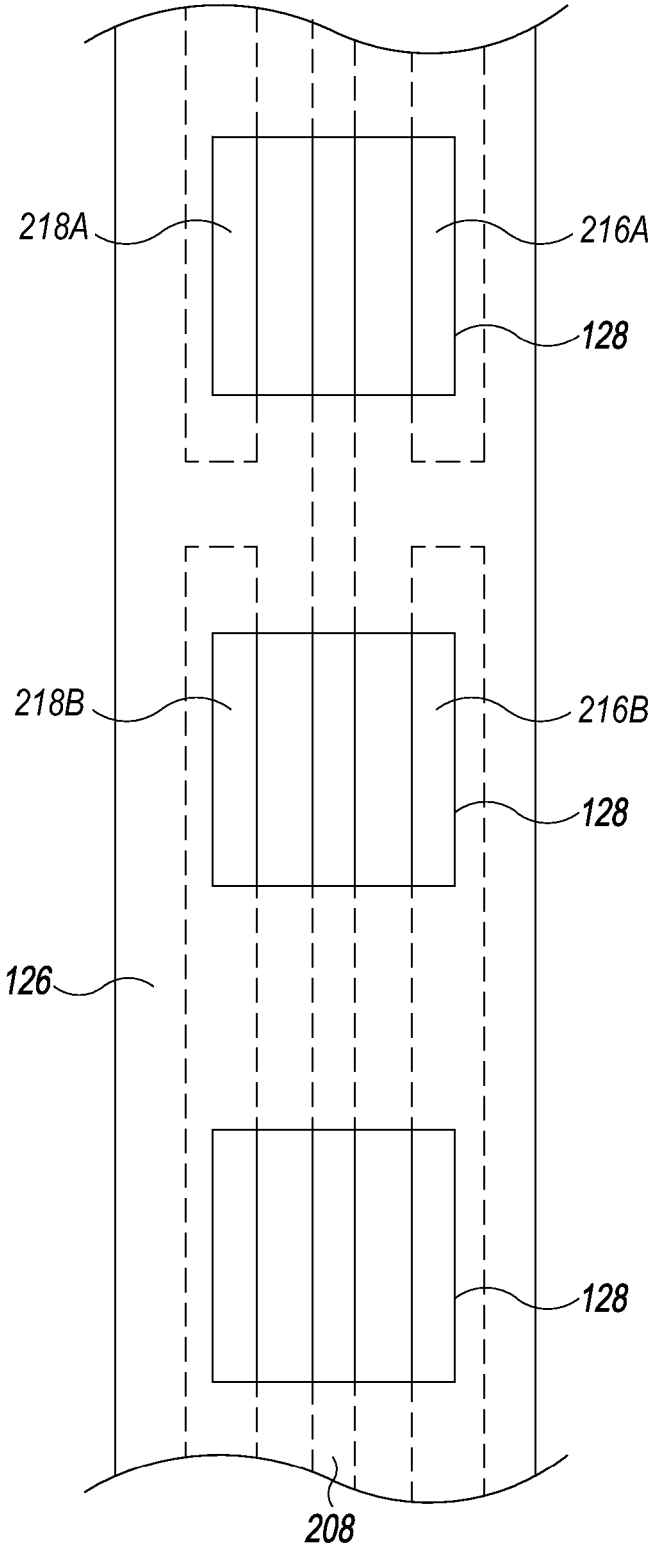
FIG. 2B is a front elevation view of one embodiment of the shelf ladder and the electrical bus of FIG. 2A.

As shown in more detail in FIGS. 2A and 2B, each of the shelf ladders 126 in the illustrative embodiment of refrigerator 100 has a number of slots 128 defined therein. In the illustrative embodiment, each of the adjustable shelves 120 includes a pair of mounting brackets 210 that are spaced apart from one another the same distance as a pair of the shelf ladders 126 (one such mounting bracket 210 being shown in FIG. 2A). The mounting brackets 210 of an adjustable shelf 120 may each engage one or more slots 128 defined in one of the shelf ladders 126 to cantilever the adjustable shelf 120 to a pair of shelf ladders 126. As such, the slots 128 defined in the shelf ladders 126 provide a plurality of shelf mounting positions for the adjustable shelves 120. In some embodiments, the adjustable shelves 120 may be fewer in number than the plurality of shelf mounting positions provided by the shelf ladders 126. In the illustrative embodiment, the slots 128 defined in the shelf ladders 126 (and, hence, the shelf mounting positions) are spaced approximately one inch apart. It will be appreciated that other configurations for the spacing of the shelf mounting positions are possible.

In the illustrative embodiment, some or all of the adjustable shelves 120 may carry one or more lighting devices for illuminating food items placed in the refrigerated compartment 106B. For instance, as described further below with respect to FIGS. 3 and 4, each of the adjustable shelves 120 may carry one or more light emitting diodes (LEDs). It is contemplated that, in some embodiments, some of the adjustable shelves 120 of the refrigerator 100 may not carry a lighting device (i.e., the refrigerator 100 may include both lighted and non-lighted adjustable shelves 120). To supply power to any lighting devices carried by one of the adjustable shelves 120, the refrigerator 100 includes an electrical connector disposed at each of the plurality of shelf mounting positions. As such, when one of the adjustable shelves 120 is removably mounted in one of the plurality of shelf mounting positions, any lighting devices carried by the adjustable shelf 120 may be electrically coupled to the corresponding electrical connector to receive power. These electrical connectors may be of any suitable type and may be placed in any suitable location relative to each shelf mounting position. For instance, in some embodiments, the electrical connectors corresponding to each shelf mounting position may be discrete electrical connectors that are electrically isolated from one another.

In the illustrative embodiment of the refrigerator 100 shown in FIG. 1, the electrical connector corresponding to each shelf mounting position may be provided within (or behind) each slot 128 defined in one or more of the shelf ladders 126. In some embodiments, an electrical bus 200 may be provided behind one or more of the shelf ladders 126, as illustrated in FIG. 2A. It will be appreciated that, where each adjustable shelf 120 engages two or more shelf ladders 126, only some of the shelf ladders 126 may include an electrical bus 200 (or other electrical connectors). The electrical bus 200 includes an insulating housing 202 that supports at least one electrical conductor 208. In some embodiments, the insulating housing 202 may include a number of protrusions 204 that snap into corresponding holes 206 on the shelf ladder 126 to secure the electrical bus 200 behind the shelf ladder 126. In other embodiments, an electrical bus 200 may be secured to one of the shelf ladders 126 using screws, bolts, rivets, adhesive, or other fixation mechanisms.

As illustrated in FIG. 2A, a mounting bracket 210 of an adjustable shelf 120 may include a number of tabs 212 configured to engage a number of slots 128 of one of the shelf ladders 126. In the illustrative embodiment, an upper tab 212 may have a hook shape that rests on a lower edge of one of the slots 128 when the adjustable shelf 120 is removably mounted in one of the shelf mounting positions. The mounting bracket 210 may also have a lower tab 212 that extends through an adjacent slot 128 of the shelf ladder 126. In some embodiments, the mounting bracket 210 may include multiple upper tabs 212 and/or multiple lower tabs 212 extending from the mounting bracket 210. Any of the tabs 212 of the mounting bracket 210 may include a conductor 214 disposed on or integrated into the tab 212. When one of the tabs 212 extends through a slot 128 defined in the shelf ladder 126 (when the adjustable shelf 120 is removably mounted in one of the shelf mounting positions), a conductor 214 carried by the tab 212 may contact the at least one conductor 208 of the electrical bus 200 behind the slot 128 to provide power to any lighting devices carried by the adjustable shelf 120. It is contemplated that each mounting bracket 210 (and each tab 212 thereof) may carry any number of conductors 214 for interfacing with any number of conductors 208 included in the electrical bus 200.

As shown in the illustrative embodiment of FIG. 2B, the electrical bus 200 may include three conductors 208, 216, 218 supported behind the shelf ladder 126. Each of the conductors 208, 216, 218 is accessible through one or more of the slots 128 of the shelf ladder 126, but is otherwise shielded by a face of the shelf ladder 126. As illustrated by the conductor 208 in FIG. 2B, some or all of the conductors of the electrical bus 200 may be continuous and be exposed in each slot 128 of the shelf ladder 126. Additionally or alternatively, as illustrated by the conductors 216, 218 in FIG. 2B, some or all of the conductors of the electrical bus 200 may be separated into discrete sections 216A, 216B, 218A, 218B that are each exposed in only some slots 128 of the shelf ladder 126. These discrete sections 216A, 216B, 218A, 218B of the conductors 216, 218 may each form independent electrical circuits with the continuous conductor 208.

As described above, a mounting bracket 210 may include any number of conductors 214 for contacting the conductors 208, 216, 218 of the electrical bus 200. For instance, in some embodiments, the mounting bracket 210 may include conductors 214 carried by one or more of the tabs 212 that contact the conductors 208, 216 of the electrical bus 200. Additionally or alternatively, the mounting bracket 210 may include conductors 214 carried by one or more of the tabs 212 that contact the conductors 208, 218 of the electrical bus 200. In some embodiments, an electrical circuit formed between the conductors 208, 216 may supply power from a first power source, while an electrical circuit formed between the conductors 208, 218 may supply power from a second power source. In such embodiments, the conductors 208, 216 may supply power at a first current level, while the conductors 208, 218 may supply power at a second current level, as further described below.

Figure 3:
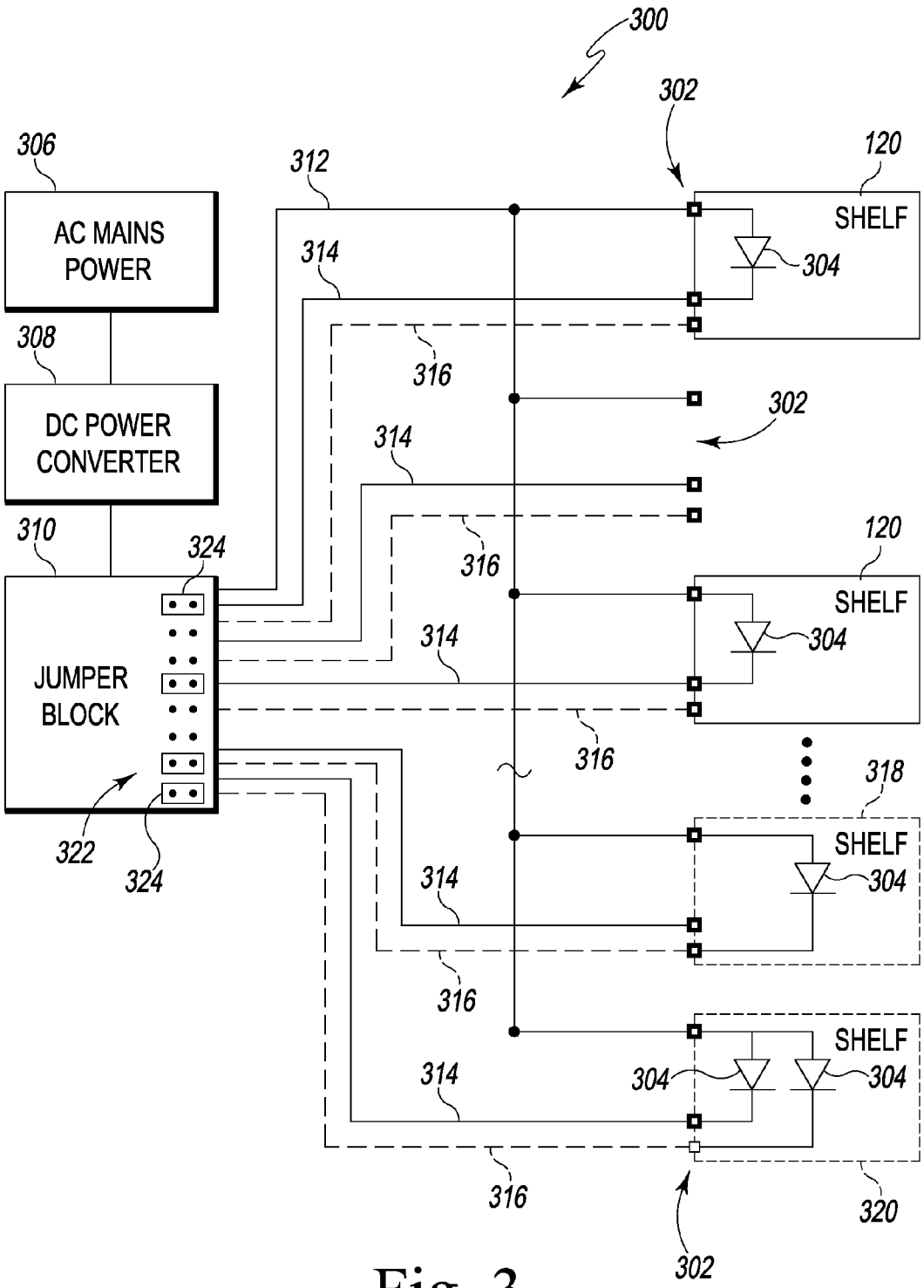
FIG. 3 is a simplified block diagram of one embodiment of a power supply circuit of the refrigerator appliance of FIG. 1.

The refrigerator 100 also includes a power supply circuit 300, one illustrative embodiment of which is shown in FIG. 3 as a simplified block diagram. The components of the power supply circuit 300 may be located in any suitable portion of the refrigerator 100, including, but not limited to, the lower frame 102, the cabinet 104, and/or the temperature-controlled compartments 106. It should be appreciated that the power supply circuit 300 may include components, sub-components, and devices other than those shown in FIG. 3, which are not illustrated for clarity of the description.

The power supply circuit 300 is electrically coupled to a number of electrical connectors 302. As noted above, each shelf mounting position in the refrigerated compartment 106B includes a corresponding electrical connector 302. By way of example, the refrigerator 100 may include an electrical connector 302 corresponding to each slot 128 defined in one or more of the shelf ladders 126 (e.g., incorporated into an electrical bus 200 mounted behind one of the shelf ladders 126). As described above, each adjustable shelf 120 that is removably mounted in one of the plurality of shelf mounting positions may interface with any number of terminals of the corresponding electrical connector 302. In embodiments in which the adjustable shelves 120 are fewer in number than the plurality of shelf mounting positions provided by the shelf ladders 126, some of the electrical connectors 302 may be open (as illustrated in FIG. 3). It will be appreciated that only some of the electrical connectors 302 of the refrigerator 100 are illustrated in FIG. 3.

Some or all of the adjustable shelves 120 may carry one or more lighting devices for illuminating food items placed in the refrigerated compartment 106B. For instance, each of the adjustable shelves 120 may carry one or more LEDs 304. As shown in FIG. 3, when an adjustable shelf 120 is removably mounted in one of the plurality of shelf mounting positions, each LED 304 carried by the adjustable shelf 120 may be electrically coupled to two terminals of the corresponding electrical connector 302. Thus, when an adjustable shelf 120 is removably mounted in one of the plurality of shelf mounting positions, the power supply circuit 300 may selectively supply power to each LED 304 carried by the adjustable shelf 120 via one of the electrical connectors 302.

The power supply circuit 300 may be electrically coupled to an AC mains power source 306, such as, for example, an electrical outlet commonly found in residential homes. The AC mains powers source 306 is electrically coupled to a DC power converter 308 of the power supply circuit 300 via a number of signal paths. These signal paths and other signal paths illustrated in FIG. 3 (and in FIG. 4) may be embodied as any type of signal paths capable of communicating electrical signals between the components of the power supply circuit 300 (or the power supply circuit 400). For example, the signal paths may be embodied as any number of wires, cables, printed circuit board traces, via, bus, intervening devices, and/or the like.

The DC power converter 308 rectifies AC power received from the AC mains power source 306 to supply DC power to other components of the power supply circuit 300. The DC power converter 308 may also transform the voltage level of the DC power to one or more appropriate voltage levels (e.g., 14 volts) for the other components of the power supply circuit 300. In some embodiments, the DC power converter 308 may also regulate the current supplied to other components of the power supply circuit 300 to provide one or more constant-current power sources. In such embodiments, these constant-current power sources may supply power at the same or different current levels. For instance, the DC power converter 308 may provide two or more constant-current power sources that each supply current at 100 milliamps. In other embodiments, the DC power converter 308 may provide a first constant-current power source that supplies current at 100 milliamps and a second constant-current power source that supplies current at lower current level, such as, for example, 30 or 50 milliamps.

The power supply circuit 300 also includes a jumper block 310 for selectively supplying power from the DC power converter 308 to each of the electrical connectors 302. The jumper block 310 is electrically coupled to the DC power converter 308 via a number of signal paths. The number of signal paths electrically coupling the jumper block 310 to the DC power converter 308 may depend on the number of power sources provided by the DC power converter 308. The jumper block 310 is also electrically coupled to each of the electrical connectors 302 via a number of signal paths. As shown in FIG. 3, one signal path 312 may be provided between the jumper block 310 and a common terminal of all of the electrical connectors 302. The signal path 312 is held at a positive voltage in the illustrative embodiment of FIG. 3, but the signal path 312 may also be held at a negative voltage or may be grounded in other embodiments.

Each electrical connector 302 is also electrically coupled to the jumper block 310 via one or more independent signal paths 314, 316. As shown in FIG. 3, one terminal of each electrical connector 302 is electrically coupled to the jumper block 310 via a signal path 314. The jumper block 310 contains several pairs of jumper pins 322 and a number of electrical jumpers 324 disposed therein. Placement of one of the electrical jumpers 324 over one of the pairs of jumper pins 322 in the jumper block 310 serves to complete an electrical circuit between the DC power converter 308 and one of the electrical connectors 302, via the signal path 312 and one of the signal paths 314. It is contemplated that, in some embodiments, some electrical connectors 302 in the refrigerator 100 may be permanently supplied with power from the DC power converter 308, while other electrical connectors 302 of the refrigerator 100 may require appropriate placement of one of the electrical jumpers 324 within the jumper block 310 to be supplied with power from the DC power converter 308. Placement of the electrical jumpers 324 within the jumper block 310 thus selects which of the electrical connectors 302 is supplied with power from the DC power converter 308. For instance, the placement of electrical jumpers 324 over only some of the pairs of jumper pins 322 in the jumper block 310 may selectively supply power to only a subset of the electrical connectors 302.

In some embodiments, an additional terminal of each electrical connector 302 may also be electrically coupled to the jumper block 310 via a signal path 316 (as shown in phantom in FIG. 3). In such embodiments, placement of one of the electrical jumpers 324 over one of the pairs of jumper pins 322 in the jumper block 310 may serve to complete an additional electrical circuit between the DC power converter 308 and one of the electrical connectors 302, via the signal path 312 and one of the signal paths 316. Where the additional signal paths 316 are provided, the power supply circuit 300 may selectively supply power to each of the electrical connectors 302 from a first power source (using the signal paths 312, 314), from a second power source (using the signal paths 312, 316), or from both the first and second power sources. As discussed above, these first and second power sources may supply power at the same or different current levels.

As shown in FIG. 3, where the power supply circuit 300 is configured to selectively supply power to each of the electrical connectors 302 from one or both of a first power source and a second power source, the refrigerator 100 may include additional types of adjustable shelves 318, 320. For instance, an adjustable shelf 318 may carry one or more LEDs 304 that electrically couple to the terminals of an electrical connector 302 that correspond to the signal path 312 and to the signal path 316 when the adjustable shelf 318 is removably mounted in one of the plurality of shelf mounting positions. As another example, an adjustable shelf 320 may carry both one or more LEDs 304 that electrically couple to the terminals of an electrical connector 302 that correspond to the signal path 312 and to the signal path 314 (like the adjustable shelf 120) and one or more LEDs 304 that electrically couple to the terminals of an electrical connector 302 that correspond to the signal path 312 and to the signal path 316 (like the adjustable shelf 318). Where the first and second power sources of the DC power converter 308 supply power at different current levels (e.g., 30, 50, or 100 milliamps), the adjustable shelves 120, 318, 320 may carry different types of LEDs 304. For instance, the adjustable shelves 120 may carry white LEDs 304, the adjustable shelves 318 may carry color LEDs 304, and the adjustable shelves 320 may carry both white and color LEDs 304.

Figure 4:
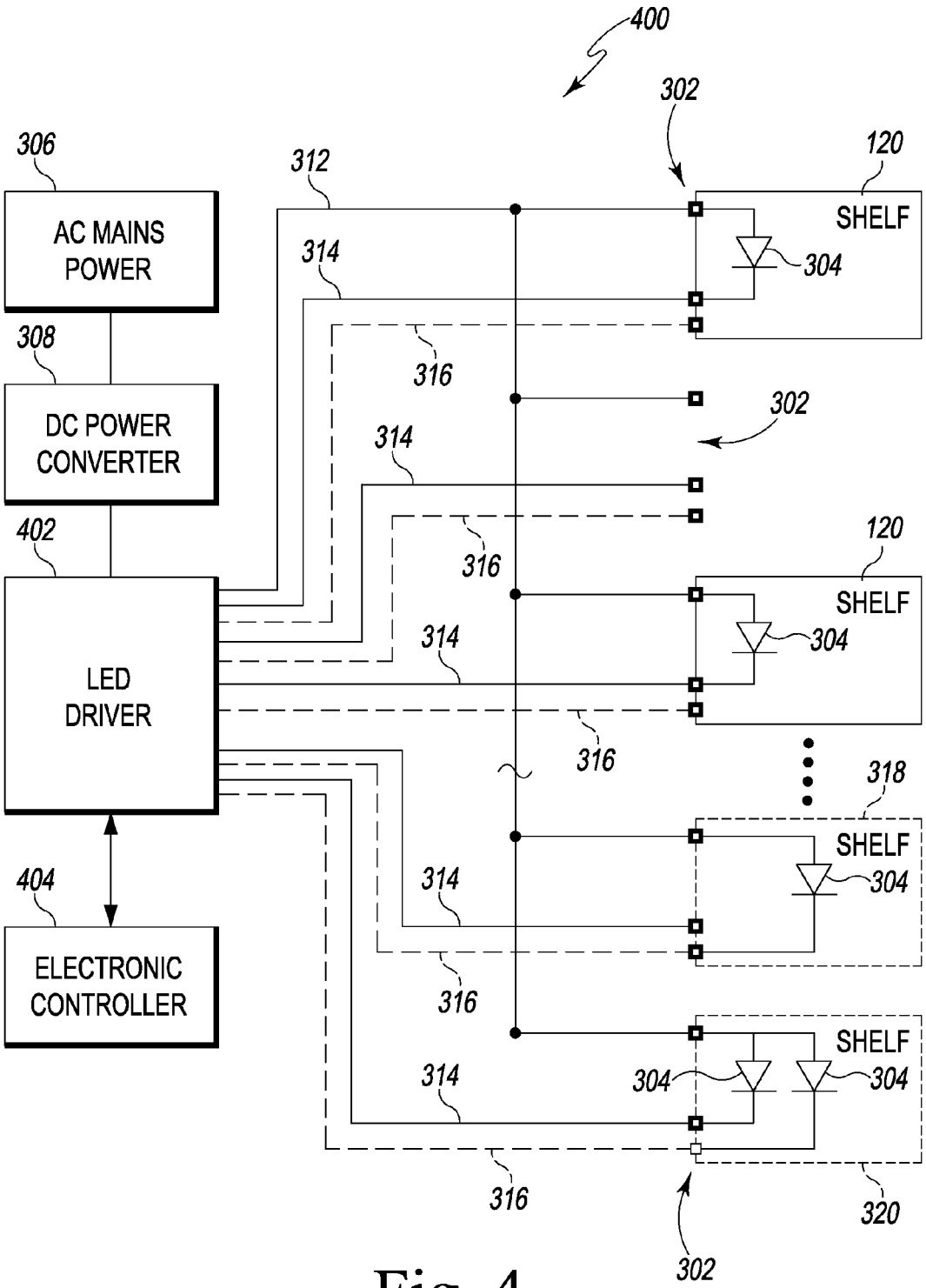
FIG. 4 is a simplified block diagram of another embodiment of the power supply circuit of the refrigerator appliance of FIG. 1.

Referring now to FIG. 4, another illustrative embodiment of a power supply circuit 400 that may be used in the refrigerator 100 is shown as a simplified block diagram. The power supply circuit 400 has a similar configuration to the power supply circuit 300, except that the jumper block 310 is replaced by an LED driver 402, which interfaces with an electronic controller 404 of the refrigerator 100. Except as noted below, the remaining components of the power supply circuit 400 may function as described above with reference to FIG. 3. The components of the power supply circuit 400 may be located in any suitable portion of the refrigerator 100, including, but not limited to, the lower frame 102, the cabinet 104, and/or the temperature-controlled compartments 106. It should be appreciated that the power supply circuit 400 may also include components, sub-components, and devices other than those shown in FIG. 4, which are not illustrated for clarity of the description.

The LED driver 402 of the power supply circuit 400 is electrically coupled to the DC power converter 308 via a number of signal paths to receive DC power from the DC power converter 308. The LED driver 402 includes a number of selectable power supply channels that may be independently activated (or deactivated) to selectively supply power to each of the electrical connectors 302. Each of the selectable power supply channels of the LED driver 402 is electrically coupled to one of the electrical connectors 302 via a signal path 314, 316. When activated, each selectable power supply channel completes an electrical circuit between the LED driver 402 and one of the electrical connectors 302 (via a signal path 312 and one of the signal paths 314 or via the signal path 312 and one of the signal paths 316) to supply power to the electrical connector 302. The LED driver 402 may be illustratively embodied as one or more AS1110 Constant-Current, 16-Channel LED Drivers with Diagnostics, commercially available from Austrian Microsystems of Unterpremstaetten, Austria.

In the illustrative embodiment of FIG. 4, the LED driver 402 also regulates the current supplied to the electrical connectors 302 to provide one or more constant-current power sources. In such embodiments, the DC power converter 308 need not provide the one or more constant-current power sources, but may merely supply a voltage source to the LED driver 402. The LED driver 402 may provide one or more constant-current power sources that supply power at the same or different current levels (e.g., 30, 50, and/or 100 milliamps). Where the power supply circuit 400 is configured to selectively supply power to each of the electrical connectors 302 from one or both of a first power source and a second power source provided by the LED driver 402, the refrigerator 100 may include additional types of adjustable shelves 318, 320. As described above, where the first and second power sources provided by the LED driver 402 supply power at different current levels, the adjustable shelves 120, 318, 320 may carry different types of LEDs 304 (e.g., white and/or color LEDs).

The power supply circuit 400 also includes an electronic controller 404 that is communicatively coupled to the LED driver 402 via a number of signal paths. The electronic controller 404 may be any type of device capable of executing software/firmware, such as a microcontroller, microprocessor, digital signal processor, or the like. The electronic controller 404 may be a dedicated controller for the power supply circuit 400 or may be a multi-function controller that also controls other operations of the refrigerator 100 (in addition to the power supply circuit 400). The electronic controller 404 may send instructions in the form of a data signal to the LED driver 402 that selectively activate (or deactivate) each of the selectable power supply channels of the LED driver 402. By running one or more software/firmware routines, the electronic controller 404 may select which of the electrical connectors 302 should be supplied with power and, in some embodiments, which power source of the LED driver 402 should supply that power. The electronic controller 404 may then send appropriate instructions to the LED driver 402 to activate the selectable power supply channels that are electrically coupled to the selected electrical connectors 302.

In the illustrative embodiment of FIG. 4, the LED driver 402 is also configured to determine an arrangement of the adjustable shelves 120 within the refrigerator 100. The LED driver 402 may enter a diagnostic mode in which the LED driver 402 senses whether each selectable power supply channel is electrically coupled to an adjustable shelf 120 carrying at least one LED 304. In this diagnostic mode, the LED driver 402 may briefly activate each selectable power supply channel (supplying power to the corresponding electrical connector 302) and may sense an electrical response to determine whether an adjustable shelf 120 carrying at least one LED 304 is coupled to the corresponding electrical connector 302. For instance, the LED driver 402 may sense whether each electrical connector 302 is open, shorted, or electrically coupled to a load (i.e., at least one LED 304). The LED driver 402 may then send information regarding the arrangement of the adjustable shelves 120 within the refrigerator 100 to the electronic controller 404 in the form of a data signal. In such embodiments, the electronic controller 404 may then selectively activate the selectable power supply channels of the LED driver 402 in response to this information regarding the arrangement of the adjustable shelves 120.

Figure 5:
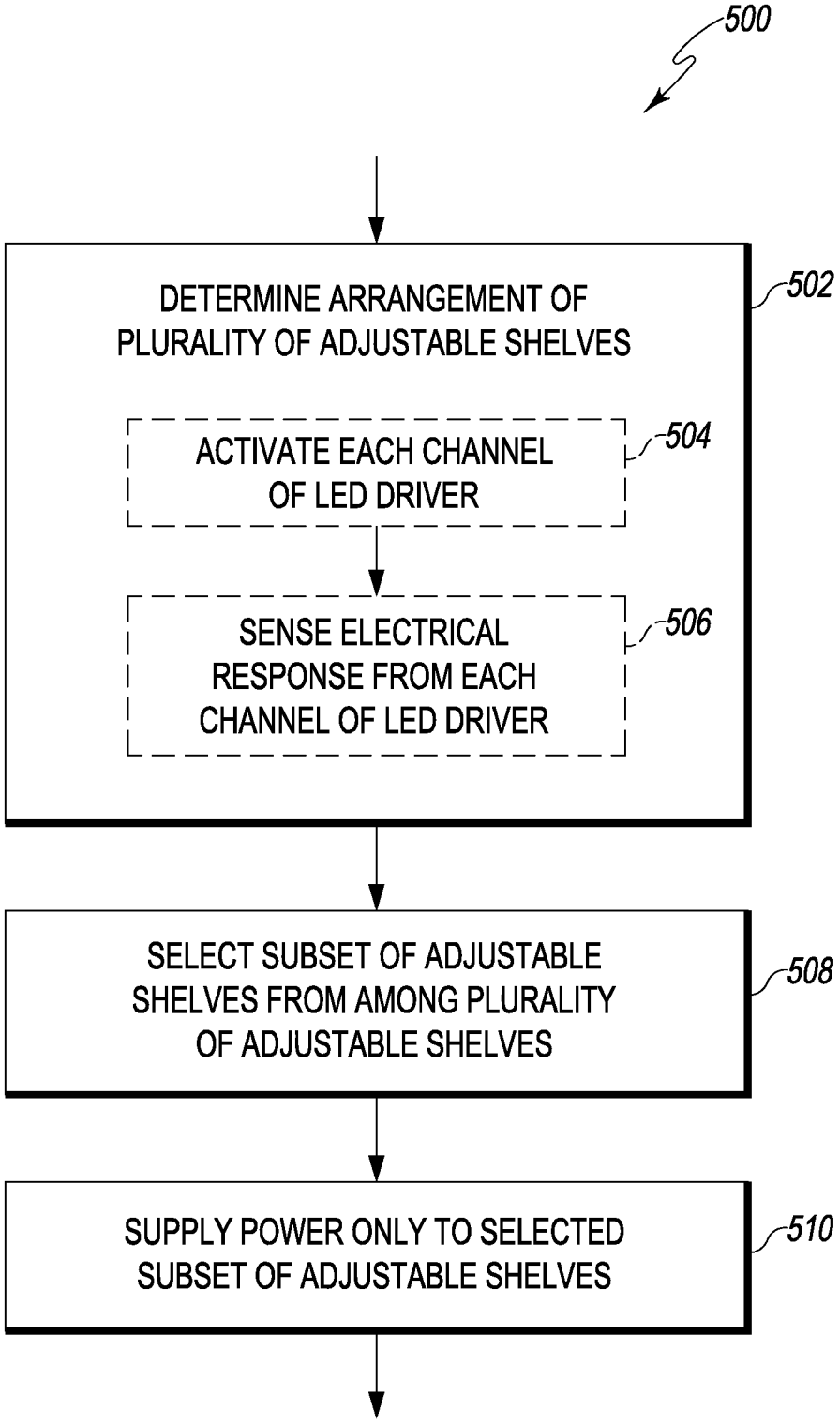
FIG. 5 is a simplified flow diagram of one embodiment of a method for selectively supplying power to a subset of the plurality of adjustable shelves of the refrigerator appliance of FIG. 1.

Referring now to FIG. 5, one illustrative embodiment of a method 500 for selectively supplying power to a subset of the adjustable shelves 120 of the refrigerator 100 is shown as a simplified flow diagram. In one illustrative embodiment, the method 500 may be performed manually by a user of the refrigerator 100 using the jumper block 310 of the power supply circuit 300. In another illustrative embodiment, the method 500 may be executed automatically by the electronic controller 404 in conjunction with other components of the power supply circuit 400. The method 500 is illustrated as a number of blocks 502-510 in FIG. 5. Blocks 504 and 506 may be optionally employed in some embodiments of the method 500 and are, therefore, indicated in phantom in FIG. 5.

The method 500 begins with block 502 in which an arrangement of the adjustable shelves 120 within the refrigerator 100 is determined. As described above, each of the adjustable shelves 120 may be removably mounted in one of a plurality of shelf mounting positions. Block 502 may be performed both when the adjustable shelves 120 are initially mounted in the refrigerated compartment 106B and each time the adjustable shelves 120 are rearranged with the refrigerated compartment 106B. In embodiments of the refrigerator 100 including the power supply circuit 300, block 502 may involve a user of the refrigerator 100 noting which of the shelf mounting positions contain one of the adjustable shelves 120 and, thus, which of the electrical connectors 302 are electrically coupled to at least one lighting device 304.

In embodiments of the refrigerator 100 including the power supply circuit 400, block 502 may be performed by the LED driver 402 in conjunction with other components of the power supply circuit 400. In such embodiments, block 502 of the method 500 may involve blocks 504 and 506 (shown in phantom in FIG. 5). In block 504, the LED driver 402 activates each selectable power supply channel (supplying power to the corresponding electrical connector 302). The LED driver 402 may activate the selectable power supply channels sequentially or simultaneously. In block 506, the LED driver 402 senses an electrical response from each selectable power supply channel to determine whether an adjustable shelf 120 carrying at least one LED 304 is coupled to the corresponding electrical connector 302. As noted above, block 506 may involve the LED driver 402 sensing whether each electrical connector 302 is open, shorted, or electrically coupled to a load (i.e., at least one LED 304). The LED driver 402 may then send information regarding the arrangement of the adjustable shelves 120 within the refrigerator 100 to the electronic controller 404 before the method 500 proceeds to block 508.

After block 502, the method 500 proceeds to block 508 in which a subset is selected from among the adjustable shelves 120 that are removably mounted in the refrigerator 100. The subset of adjustable shelves 120 selected in block 508 will be less than all of the adjustable shelves 120 that are removably mounted in the refrigerator 100. A subset of the electrical connectors 302 to be supplied with power (and, hence, the subset of adjustable shelves 120 to be supplied with power) may be selected using any number of considerations based on the arrangement of the adjustable shelves 120 determined in block 502. For instance, the subset of electrical connectors 302 to be supplied with power may be selected so as not to exceed a maximum power level that may be supplied by the power supply circuit 300, 400 (or a desired power level not to be exceeded). Additionally or alternatively, the subset of electrical connectors 302 to be supplied with power may be selected to achieve desired lighting conditions within the refrigerated compartment 106B. For instance, where two adjustable shelves 120 are removably mounted in nearby shelf mounting positions, it may not be necessary to supply power to lighting devices carried by both adjustable shelves 120 and only one of the two adjustable shelves 120 may be supplied with power.

In embodiments of the refrigerator 100 including the power supply circuit 300, block 508 may involve configuring the electrical jumpers 324 within the jumper block 310. As described above, placement of the electrical jumpers 324 within the jumper block 310 will select which of the electrical connectors 302 is supplied with power by the power supply circuit 300. In embodiments of the refrigerator 100 including the power supply circuit 400, block 508 may involve the electronic controller 404 executing one or more software/firmware routines to process the information regarding the arrangement of the adjustable shelves 120 sent by the LED driver 402 in block 502. The electronic controller 404 may then select which of the electrical connectors 302 should be supplied with power by the power supply circuit 400 and send appropriate instructions to the LED driver 402.

After block 508, the method 500 proceeds to block 510 in which the power supply circuit 300, 400 supplies power to the at least one LED 304 carried by each of the subset of adjustable shelves 120 selected in block 508. In embodiments of the refrigerator 100 including the power supply circuit 400, block 510 may involve the LED driver 402 activating particular selectable power supply channels in response to instructions received from the electronic controller 404 in block 508. It will be appreciated that, during block 510, the power supply circuit 300, 400 may intermittently supply power to the select subset of electrical connectors 302 only when a door 112 of the refrigerator 100 is opened, as is commonly known in the art.

There are a plurality of advantages of the present disclosure arising from the various features of the systems, apparatus, and methods described herein. It will be noted that alternative embodiments of the systems, apparatus, and methods of the present disclosure may not include all of the features described yet still benefit from at least some of the advantages of such features. Those of ordinary skill in the art may readily devise their own implementations of the systems, apparatus, and methods that incorporate one or more of the features of the present invention and fall within the spirit and scope of the present disclosure as defined by the appended claims.

The invention claimed is:

1. A refrigerator appliance comprising:

a cabinet having a temperature-controlled compartment defined therein;

a shelf ladder disposed in the temperature-controlled compartment and providing a plurality of shelf mounting positions, the shelf ladder comprising a plurality of electrical connectors such that each of the plurality of shelf mounting positions has a corresponding electrical connector;

a plurality of adjustable shelves each carrying at least one lighting device, each of the plurality of adjustable shelves being removably mounted in one of the plurality of shelf mounting positions such that the at least one lighting device is electrically coupled to the corresponding electrical connector, wherein the plurality of adjustable shelves includes a first shelf and a second shelf; and a power supply circuit that is electrically coupled to the plurality of electrical connectors of the shelf ladder, the power supply circuit being configured to: a) determine which of the plurality of shelf mounting positions the first shelf is mounted in; b) determine which of the plurality of shelf mounting positions the second shelf is mounted in; and c) supply power to the first shelf based on the determined position of the first shelf and the determined position of the second shelf.

2. The refrigerator appliance of claim 1, wherein the plurality of adjustable shelves are fewer in number than the plurality of shelf mounting positions provided by the shelf ladder.

3. The refrigerator appliance of claim 1, wherein the plurality of electrical connectors are part of an electrical bus that corresponds to two or more of the plurality of shelf mounting positions.

4. The refrigerator appliance of claim 1, wherein the at least one lighting device carried by each of the plurality of adjustable shelves comprises at least one light emitting diode (LED), and wherein the power supply circuit comprises an LED driver having a plurality of selectable power supply channels, each of the plurality of selectable power supply channels being electrically coupled to one of the plurality of electrical connectors.

5. The refrigerator appliance of claim 4, wherein:

the power supply circuit further comprises an electronic controller communicatively coupled to the LED driver, the electronic controller being configured to selectively activate the plurality of selectable power supply channels of the LED driver;

the LED driver is configured to determine an arrangement of the plurality of adjustable shelves by sensing whether each of the plurality of selectable power supply channels is electrically coupled to at least one lighting device; and the electronic controller is configured to selectively activate the plurality of selectable power supply channels of the LED driver in response to the arrangement of the plurality of adjustable shelves.

6. The refrigerator appliance of claim 1, wherein the power supply circuit is further configured to selectively supply power to each of the plurality of electrical connectors from one or both of a first power source and a second power source, and wherein the first power source is configured to supply power to the plurality of electrical connectors at a first current level and the second power source is configured to supply power to the plurality of electrical connectors at a second current level, the first current level being greater than the second current level.

7. The refrigerator appliance of claim 1, wherein the power supply circuit selectively supplies power to less than all of the plurality of adjustable shelves mounted in the plurality of shelf mounting positions through a subset of the plurality of electrical connectors.

8. The refrigerator appliance of claim 7, wherein the power supply circuit selectively supplies power to less than all of the plurality of shelves mounted in the plurality of shelf mounting positions based on which of the plurality of shelf mounting positions the plurality of adjustable shelves are mounted in.

9. A refrigerator appliance comprising:

a cabinet having a temperature-controlled compartment defined therein;

a plurality of electrical connectors disposed at a plurality of shelf mounting positions within the temperature-controlled compartment;

a plurality of adjustable shelves each carrying at least one light emitting diode (LED), each of the plurality of adjustable shelves being removably mounted in one of the plurality of shelf mounting positions such that the at least one LED is electrically coupled to one of the plurality of electrical connectors, wherein the plurality of adjustable shelves includes a first shelf and a second shelf; and a power supply circuit that is electrically coupled to the plurality of electrical connectors, the power supply circuit being configured to: a) determine which of the plurality of shelf mounting positions the first shelf is mounted in; b) determine which of the plurality of shelf mounting positions the second shelf is mounted in; and c) supply power to the first shelf based on the determined position of the first shelf and the determined position of the second shelf.

10. The refrigerator appliance of claim 9, wherein the power supply circuit comprises an LED driver having a plurality of selectable power supply channels, each of the plurality of selectable power supply channels being electrically coupled to one of the plurality of electrical connectors.

11. The refrigerator appliance of claim 10, wherein:

the power supply circuit further comprises an electronic controller communicatively coupled to the LED driver, the electronic controller being configured to selectively activate the plurality of selectable power supply channels of the LED driver;

the LED driver is configured to determine an arrangement of the plurality of adjustable shelves by sensing whether each of the plurality of selectable power supply channels is electrically coupled to at least one LED; and the electronic controller is configured to selectively activate the plurality of selectable power supply channels of the LED driver in response to the arrangement of the plurality of adjustable shelves.

12. The refrigerator appliance of claim 9, wherein the power supply circuit is further configured to selectively supply power to each of the plurality of electrical connectors from one or both of a first power source and a second power source, the first power source being configured to supply power to the plurality of electrical connectors at a greater current level than the second power source.

13. The refrigerator appliance of claim 9, wherein the power supply circuit selectively supplies power to less than all of the plurality of shelves mounted in the plurality of shelf mounting positions based on which of the plurality of shelf mounting positions the plurality of adjustable shelves are mounted in.

14. A method comprising:

determining an arrangement of a plurality of adjustable shelves, including a first shelf and a second shelf, in a refrigerator appliance, each of the plurality of adjustable shelves carrying at least one light emitting diode (LED) and being removably mounted within a temperature-controlled compartment of the refrigerator appliance, wherein determining the arrangement of the plurality of adjustable shelves includes determining a position of the first shelf and determining a position of the second shelf;

selecting a subset of adjustable shelves from among the plurality of adjustable shelves mounted in the refrigerator appliance in response to the determined arrangement of the plurality of adjustable shelves, wherein the selected subset of adjustable shelves is less than all of the plurality of adjustable shelves mounted in the refrigerator appliance, wherein selecting the subset of adjustable shelves includes selecting the first shelf based on the determined position of the first shelf and the determined position of the second shelf; and supplying power to the at least one LED carried by each of the selected subset of adjustable shelves.

15. The method of claim 14, wherein selecting the subset of adjustable shelves comprises configuring a plurality of electrical jumpers within a jumper block.

16. The method of claim 14, wherein supplying power to the at least one LED carried by each of the selected subset of adjustable shelves comprises activating one or more selectable power supply channels of an LED driver, the LED driver including a selectable power supply channel electrically coupled to each location for removably mounting one of the plurality of adjustable shelves within the temperature-controlled compartment.

17. The method of claim 16, wherein determining the arrangement of the plurality of adjustable shelves comprises:

activating each selectable power supply channel of the LED driver; and sensing an electrical response from each selectable power supply channel of the LED driver to determine whether one of the plurality of adjustable shelves is electrically coupled to the selectable power supply channel.

18. The method of claim 14, wherein selecting the subset of adjustable shelves from among the plurality of shelves mounted in the refrigerator appliance in response to the determined arrangement of the plurality of adjustable shelves includes selecting the subset of adjustable shelves based on where the plurality of adjustable shelves are mounted in the temperature-controlled compartment.

* * * * *